US005980058A

United States Patent [19]

Guess et al.

[11] Patent Number: 5,980,058

[45] Date of Patent: Nov. 9, 1999

[54] MODULAR ASSEMBLY AND METHOD FOR A REFRIGERATOR

[75] Inventors: Ronald W. Guess, Evansville; Rex P. Mowery, Veale Township, Daviess County, both of Ind.; Stoney Q. McGowan, Versailles, Ky.

[73] Assignee: Whirlpool Corporation, Benton Harbor, Mich.

[21] Appl. No.: 08/505,713

[22] Filed: Jul. 11, 1995

Related U.S. Application Data

[63] Continuation of application No. 08/176,026, Dec. 30, 1993, abandoned.

[51] Int. Cl.[6] ..... F21V 33/00

[52] U.S. Cl. ..... 362/94; 362/155; 362/295

[58] Field of Search ..... 362/92, 94, 155, 362/154, 156, 133, 129, 126, 132, 127, 145; 62/264

[56] References Cited

U.S. PATENT DOCUMENTS

| | | | |
|---|---|---|---|
| 1,149,140 | 8/1915 | Hess | 362/125 |
| 1,243,453 | 10/1917 | Smith | 362/125 |
| 1,435,798 | 11/1922 | Biller | 362/125 |
| 2,122,293 | 6/1938 | Pleasant et al. | 362/94 |
| 2,148,787 | 2/1939 | Thomas | 362/94 |
| 2,156,443 | 5/1939 | Zook | 362/94 X |
| 2,156,462 | 5/1939 | Schulte | 362/94 X |
| 2,215,123 | 9/1940 | Kalischer | 62/264 |
| 2,644,882 | 7/1953 | Voda | 362/94 |
| 2,918,565 | 12/1959 | Vermette | 362/94 X |
| 2,930,885 | 3/1960 | Ehrenfreund | 362/94 |
| 3,572,049 | 3/1971 | Moorman | 62/132 |
| 3,862,411 | 1/1975 | Persson | 362/431 |
| 4,949,229 | 8/1990 | Bassi | 362/92 |
| 4,992,913 | 2/1991 | Buscella | 362/94 |
| 5,034,861 | 7/1991 | Sklenak et al. | 362/92 |
| 5,177,976 | 1/1993 | Lim et al. | 62/131 |

*Primary Examiner*—Thomas M. Sember
*Attorney, Agent, or Firm*—Robert O. Rice; Thomas J. Roth; Andrea Powers Denklau

[57] ABSTRACT

A modular lighting assembly is provided for a refrigerator which has a molded base plate carrying a light bulb, a light switch and electrical connectors between the light switch and light bulb. The light switch may be either a plunger type switch or other types of switch such as a magnetic switch. The light is positioned adjacent to the switch so as to avoid the necessity of having a wire harness extend within the refrigerator cabinet between those two components.

31 Claims, 2 Drawing Sheets

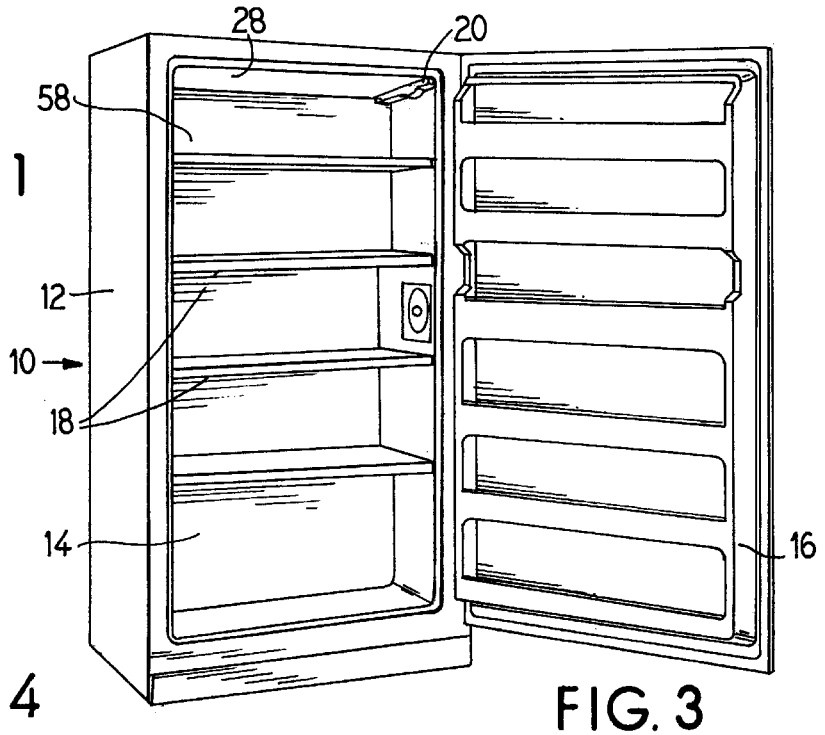
FIG. 1
FIG. 4
FIG. 3
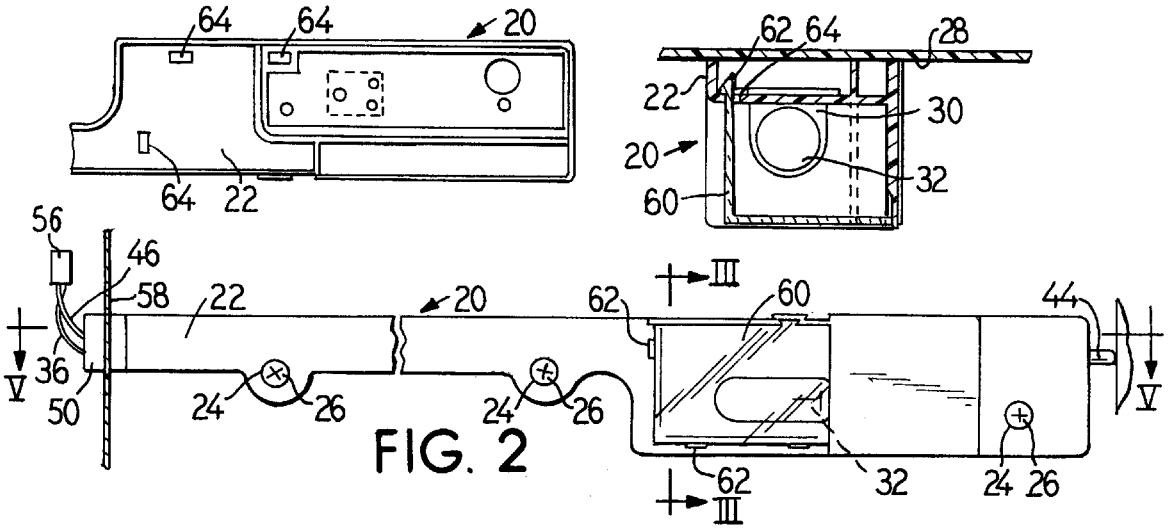
FIG. 2
FIG. 5
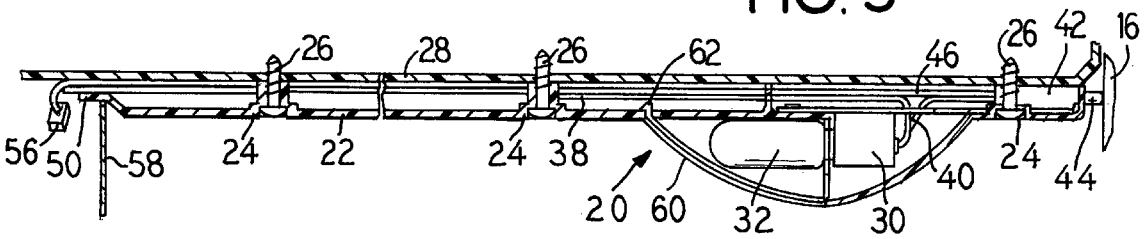

MODULAR ASSEMBLY AND METHOD FOR A REFRIGERATOR

This is a continuation of application Ser. No. 08/176,026, filed Dec. 30, 1993 now abandoned.

BACKGROUND OF THE INVENTION

In various types of cabinet structures, such as a refrigerator having an openable door and a compartment with a number of shelves therein, it is desireable to light the compartment in a cost effective and aesthetically pleasing way. In a typical freezer or refrigerator compartment it has been known to secure a light socket in the back section of the compartment and to foam the light socket in place when the insulation foam is injected between the liner and the cabinet shelf. A foamed in place light switch assembly consisting of a light switch, a recessed cover and a seal is installed adjacent to the front opening to be engaged by the door. Extending between the light switch and the light socket is a wiring harness which must be put into place prior to the insulation being injected into the space between the liner and the cabinet wall. A light lens and a light bulb complete the assembly.

Such an arrangement, while serviceable, requires a significant amount of labor for assembly and requires lighted cabinets to be formed differently from non-lighted cabinets. Also, such an arrangement places the light at the rear of the cabinets so that the back sides of objects being stored within the cabinet are lit rather than the front sides as viewed by the user.

SUMMARY OF THE INVENTION

The present invention provides a modular lighting assembly for use in a cabinet which greatly reduces the assembly time and material cost, while providing a reliable lighting fixture which can be mounted so as to provide a front lighting for the objects stored within the cabinet.

The module consists of a molded base plate that houses a light bulb, a light lens, electrical connections and a switch. The module is an elongated member so that at the back of the module there is a track with wires to extend behind an evaporator cover when used in a refrigerator. This allows for a connection to the power source.

By placing the bulb in close proximity to the switch, the need for a wiring harness between the bulb and the switch assembly is eliminated. Stamp metal foil or die-cut metal tracks may make up the switch contacts, electrical pads and light bulb connections, all carried in the molded base plate.

The switch itself could be either a plunger switch which is engaged by the door when it closes, or could be a magnetic switch which is arranged to interact with an element carried on the door so as to change the state of the switch depending on whether the door is open or closed. Further, two bulbs may be mounted in the housing to enhance the amount of light provided by the lighting fixture.

BRIEF DESCRIPTION OF THE DRAWINGS

FIG. 1 is a perspective view of a refrigerator illustrating placement of a lighting module in accordance with the present invention.

FIG. 2 is a plan view of an embodiment of the lighting assembly of FIG. 1.

FIG. 3 is a sectional view of the lighting assembly taken generally along the lines III—III of FIG. 2.

FIG. 4 is a partial bottom elevational view of a base plate of the lighting module.

FIG. 5 is a side sectional view taken generally along the line V—V of FIG. 2.

DETAILED DESCRIPTION OF THE PREFERRED EMBODIMENTS

Figure 6:
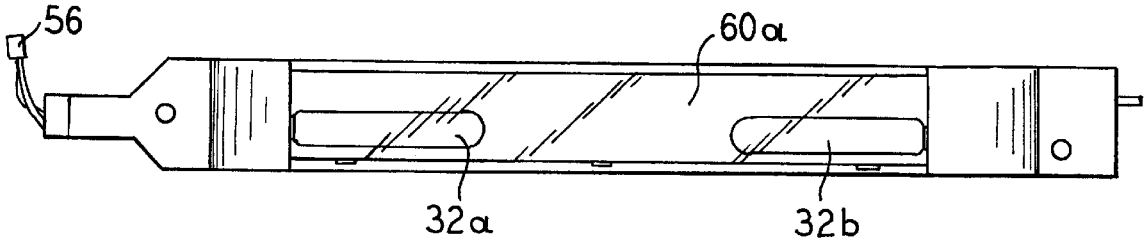
FIG. 6 is a plan view of an alternate embodiment of the modular lighting assembly.

The present invention relates to a modular lighting assembly and magnetic switch therefor which can be used in a wide variety of environments. One particular environment in which the modular lighting assembly finds particular utility is within a refrigeration appliance. Although the invention is not limited to such an environment, this environment will be used to provide a description of the invention.

FIG. 1 illustrates a refrigeration appliance generally at 10 which comprises a cabinet 12 having an open front 14 which is closed by a movable member such as a door 16. In typical refrigeration appliances the door is mounted on hinges so as to swing between an open and closed position.

Within the cabinet 12 there are a plurality of shelves 18 for receiving various items thereon. In order to enhance visibility within the cabinet there is provided a lighting fixture 20 which, as will be described in detail below, is responsive to the position of the door 16 such that when the door is opened, the lighting fixture is energized.

The lighting fixture 20 is shown in greater detail in FIGS. 2–5 where it is seen that the lighting fixture 20 comprises a modular assembly having a molded base plate 22 which is an elongated member having a length generally equal to a depth of the interior of the appliance cabinet 12. The base plate 22 has a plurality of apertures 24 therein for receiving fastening members 26 which extend through the base plate 22 and into a supporting wall 28 of the cabinet. The molded base plate 22 carries an internally threaded socket 30 for receiving a threaded end of a light bulb 32.

The socket 30 is provided with an electrical conductor 38 extending the length of the base member 22. A second electrical conductor 40 connects the socket 30 with a switch 42. A plunger 44 is carried in the switch 42. The plunger is spring biased to be pressed outwardly from the housing 22, but when the door 16 of the appliance is closed, the door will press against the plunger 44 and open the switch 42. A third conductor 46 leads from the switch 42 and also extends the length of the base plate 22.

At a rear end 50 of the molded base plate 22 these conductors 38, 46 may be provided with a terminal member 56. This portion of the base plate 22 is designed to protrude through an evaporator cover 58 in the rear of the refrigeration appliance cabinet. The terminal 56 is then connected to a wiring harness for connection to a source of electrical power. Thus, when the plunger 44 is released by opening the door 16, electrical contact is made and the circuit is closed through the light bulb so that the light bulb will be energized. The conductors 38, 40 and 46 may be in the form of wires, stamp metal foil printed circuit board tracks or die cut metal tracks.

A light bulb cover 60 may be provided which has tabs 62 to extend through openings 64 in the molded base plate 22 so that the cover can be snapped onto or snapped off of the molded base plate as desired so as to protect the light bulb 32. The light bulb cover 60 should be made from a transparent, translucent or opaque material.

Figure 7:
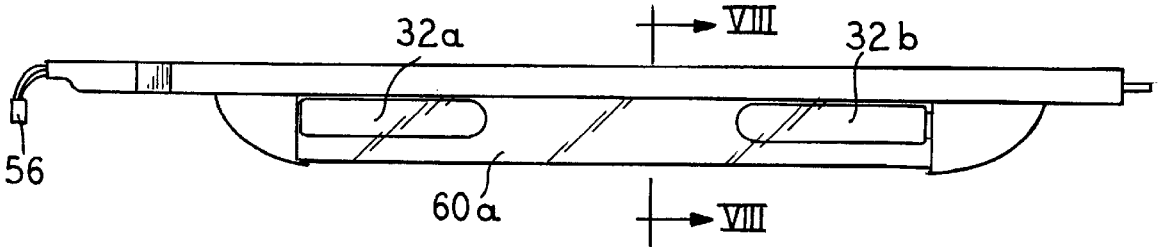
FIG. 7 is a side elevational view of the embodiment of FIG. 5.
Figure 8:
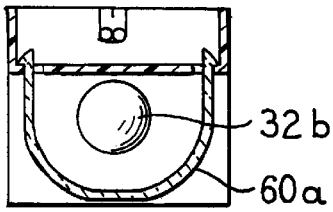
FIG. 8 is a sectional view taken generally along the line VIII—VIII of FIG. 7.

FIGS. 6–8 illustrate an alternate embodiment of the invention in which two light bulbs 32*a*, 32*b* are provided. Such an arrangement will provide an enhanced lighting of the interior of the cabinet 12. The remainder of the construction of the lighting assembly will remain essentially the same as that described with respect to FIGS. 2–4 above, noting that an enlarged single light lens 60*a* is provided.

Figure 9:
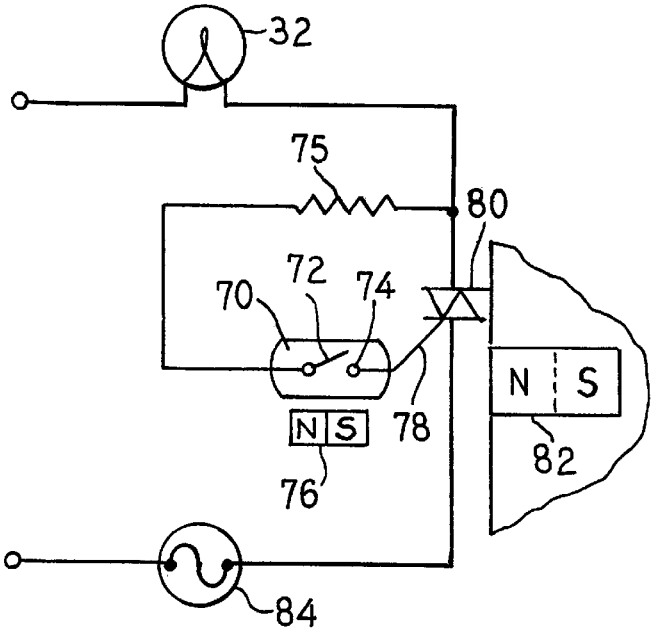
FIG. 9 is a schematic illustration of a magnetic switch embodiment useful in the lighting assembly.

FIG. 9 illustrates a switch which may be utilized in the modular lighting assembly in lieu of the plunger arrangement shown in detail in FIG. 4. In this arrangement a magnetic switch is utilized. This circuit uses three electronic components (a reed switch, a resistor and a triac) and it draws no current in the off mode. A reed switch 70 is used having a movable reed 72 which can be magnetically biased into engagement with an electrical contact 74 to permit conduction of an electrical current through the reed 72. A small magnet 75 is mounted next to the reed 72 to pre-energize the reed and to bias it into engagement with the contact 74. This closed contact delivers current through a resistor 76 into a gate 78 of a triac 80. This gate current turns on the triac 80 and delivers voltage to the light bulb 32. This "on" position would occur when the refrigerator door is open. A large magnet 82 is mounted in the refrigerator door 16 and is moved into close proximity to the reed switch when the refrigerator door is closed. The large magnet 82 cancels out the effect of the small magnet 76 and allows the reed contact 72 to open. When the contact opens, the light bulb 32 is turned off. Such a switch provides a highly reliable and low cost arrangement. A thermal fuse 84 may be provided to protect the circuit in the event of an overheating condition.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A refrigerator comprising:

a cabinet having top, bottom, rear, and opposing side walls, all of which have interior surfaces defining an interior compartment with an open front;

a door moveably mounted to the cabinet for movement between an opened and a closed position to uncover and cover the open front for providing selective access to the interior compartment; and a modular light assembly comprising:

a housing having an elongated base plate with a proximal end and a terminal end and a cover, which in combination define a light bulb recess, and the base plate being mounted to the interior surface of at least one of the walls so that the base plate and the light bulb recess are disposed within the interior compartment;

at lease one light bulb socket mounted to the housing and disposed within the light bulb recess, whereby the light bulb socket is adapted to mount a light bulb for illuminating the interior compartment; and a switch operable by an alternate current source and mounted to the base plate and electrically connected to the light bulb socket, and the switch being activated by the door so that upon the opening of the door the switch energizes the light bulb socket and upon the closing of the door the switch de-energizes the light bulb socket.

2. A refrigerator according to claim 1, wherein the base plate extends from the rear wall to the open front and the proximal end is adjacent the rear wall and the distal end is adjacent the open front.

3. A refrigerator according to claim 2, wherein the modular light assembly further comprises a wiring terminal electrically connected to the light bulb socket and whereby the wiring terminal can be connected to a power source for the refrigerator to supply electrical power to the light bulb socket and the switch.

4. A refrigerator according to claim 3, wherein the wiring terminal extends from the base near the proximal end and the switch is mounted to the base near the distal end.

5. A refrigerator according to claim 4, wherein one of the walls near the proximal end of the base has a terminal aperture through which the wiring terminal passes to be connected to a power source for the refrigerator.

6. A refrigerator according to claim 5, wherein the base has a collar extending from the proximal end which is received within the terminal aperture to locate the base when the modular light assembly is mounted to the one of the walls.

7. A refrigerator according to claim 5, wherein the rear wall has the terminal aperture.

8. A refrigerator according to claim 3, wherein the modular light assembly further comprises electrical connectors electrically connecting the light bulb socket, switch and wiring terminal.

9. A refrigerator according to claim 8, wherein the electrical connectors are stamp metal foil tracks.

10. A refrigerator according to claim 8, wherein the electrical connectors are die-cut metal tracks.

11. A refrigerator according to claim 8, wherein the electrical connectors are wires.

12. A refrigerator according to claim 8, wherein the electrical connectors are printed circuit board tracks.

13. A refrigerator according to claim 12, wherein the cover is a light lens.

14. A refrigerator according to claim 12, wherein a second light bulb socket is mounted to the housing and positioned within the light bulb recess.

15. A refrigerator according to claim 8, wherein the switch is a plunger switch.

16. A refrigerator according to claim 8, wherein the switch is a magnetic switch.

17. A refrigerator according to claim 16, wherein the magnetic switch comprises:

a reed switch having a movable reed that can be magnetically biased into abutment with an electrical contact to permit conduction of an electrical current through the reed;

a first magnet mounted to the housing adjacent the reed to nominally bias the reed into conducting contact with the electrical contacts; and a second magnet mounted to the door to be moved into close proximity with the switch when the door is closed, and the second magnet being of sufficient strength and orientation relative to the first magnet so as to cancel the effect of the first magnet on the reed to bias the reed away from the contact when the door is closed.

18. A refrigerator according to claim 1, wherein the modular light assembly further comprises a wiring terminal electrically connected to the light bulb socket and whereby the wiring terminal can be connected to a power source for the refrigerator to supply electrical power to the light bulb socket and the switch.

19. A refrigerator according to claim 18, wherein the wiring terminal extends from the base near the proximal end and the switch is mounted to the base near the distal end.

20. A refrigerator according to claim 19, wherein one of the walls near the proximal end of the base has a terminal aperture through which the wiring terminal passes to be connected to a power source for the refrigerator.

21. A refrigerator according to claim 20, wherein the rear wall has the terminal aperture.

22. A refrigerator according to claim 1, wherein the modular light assembly further comprises electrical connectors electrical connecting the light bulb socket, switch and wiring terminal.

23. A refrigerator according to claim 22, wherein the electrical connectors are stamp metal foil tracks.

24. A refrigerator according to claim 22, wherein the electrical connectors are die-cut metal tracks.

25. A refrigerator according to claim 22, wherein the electrical connectors are wires.

26. A refrigerator according to claim 22, wherein the electrical connectors are printed circuit board tracks.

27. A refrigerator according to claim 1, wherein the switch is a plunger switch.

28. A refrigerator according to claim 1, wherein the switch is a magnetic switch.

29. A refrigerator according to claim 28, wherein the magnetic switch comprises:

a reed switch having a movable reed that can be magnetically biased into abutment with an electrical contact to permit conduction of an electrical current through the reed;

a first magnet mounted to the housing adjacent the reed to nominally bias the reed into conducting contact with the electrical contacts; and a second magnet mounted to the door to be moved into close proximity with the switch when the door is closed, and the second magnet being of sufficient strength and orientation relative to the first magnet so as to cancel the effect of the first magnet on the reed to bias the reed away from the contact when the door is closed.

30. A refrigerator according to claim 1, wherein the cover is a light lens.

31. A refrigerator according to claim 1, wherein a second light bulb socket is mounted to the housing and positioned within the light bulb recess.

* * * * *